United States Patent [19]

Worgt et al.

[11] 4,236,551

[45] Dec. 2, 1980

[54] METHOD OF AND APPARATUS FOR COOLING ROLLED WIRE

[75] Inventors: Walter Worgt; Gerhard Pechau; Ewald Wyzgol; Manfred Franz, all of Magdeburg, German Democratic Rep.

[73] Assignee: VEB Schwermaschinenbau-Kombinat Ernst Thälmann Magdeburg, Magdeburg, German Democratic Rep.

[21] Appl. No.: 947,076

[22] Filed: Sep. 29, 1978

[30] Foreign Application Priority Data

Oct. 21, 1977 [DE] Fed. Rep. of Germany ..... 2120163

[51] Int. Cl.[3] ..... B21F 21/00; C21D 9/52; C21D 9/56

[52] U.S. Cl. ..... 140/1; 140/2; 148/12 B; 148/156; 266/106; 266/113

[58] Field of Search ..... 29/DIG. 39, DIG. 32, 29/33 F; 140/1, 2; 242/79, 82; 266/113, 106, 109, 103, 119, 142, 251, 259; 148/12 B, 156; 62/64

[56] References Cited

U.S. PATENT DOCUMENTS

| | | | |
|---|---|---|---|
| 3,339,373 | 9/1967 | Mobius et al. | 62/64 |
| 3,490,500 | 1/1970 | Dopper et al. | 140/1 |
| 3,507,712 | 4/1970 | Scott | 266/113 X |
| 3,645,805 | 2/1972 | Hoffmann et al. | 148/12 B X |
| 3,770,025 | 11/1973 | Hirschfelder et al. | 140/2 |
| 3,914,135 | 10/1975 | Kozasu et al. | 266/113 X |
| 4,108,695 | 8/1978 | Paulitsch et al. | 148/12 B X |

FOREIGN PATENT DOCUMENTS

| | | | |
|---|---|---|---|
| 1279605 | 10/1968 | Fed. Rep. of Germany | 140/2 |
| 127063 | 7/1977 | German Democratic Rep. | 140/1 |

*Primary Examiner*—Arthur C. Prescott
*Attorney, Agent, or Firm*—Karl F. Ross

[57] ABSTRACT

A steel wire directly from the rolling mill is formed into a horizontally advancing helix having a succession of upstanding turns. This helix is fed into a horizontally opening end of an elbow and a roller at the short side of the elbow deflects the helix so that it exits from the downwardly opening outlet end of the elbow. An upright cooling tube is provided immediately at this downstream end and has a multiplicity of throughgoing holes each aligned with a respective nozzle for spraying of liquid on the descending coil so as rapidly to cool it and to transform at least the surface of it into martinsite. At the lower end of the tube the cooled coil, at a temperature of 500° C.–600° C. as compared with the starting temperature of 750° C., is carried horizontally away by a conveyor.

11 Claims, 5 Drawing Figures

METHOD OF AND APPARATUS FOR COOLING ROLLED WIRE

FIELD OF THE INVENTION

The present invention relates to a method of an apparatus for treating a wire. More particularly this invention concerns a system for cooling a rolled wire immediately after it has been rolled and formed into a helix.

BACKGROUND OF THE INVENTION

A rolled steel wire is normally formed immediately after rolling into a horizontally oriented and advancing helix having a plurality of vertically standing turns. This helix or coil is fed into the upstream end of a horizontally extending tube that is rotated about its central horizontal axis. Water is sprayed tangentially into this upstream end and air jets are directed tangentially into the downstream end of the cooling tube. In this manner a water film is formed on the interior of the tube, so that the coil is cooled by this water as it advances horizontally along the tube.

This known method has several disadvantages. First of all conveying the wire with its turns oriented vertically presents some difficulty, and frequently results in the coil collapsing and jamming the apparatus. Furthermore, the cooling effect is bad to control, and it is quite difficult to form a perfectly uniform layer of water on the inside of the tube, as is necessary for most effective cooling. Normally the layer of water is much deeper at the bottom of the tube than at the top, so that the turns of the coil or helix will not be uniformally treated.

OBJECTS OF THE INVENTION

It is therefore an object of the present invention to provide an improved method of and apparatus for treating a wire.

Another object is to provide an improved system for cooling a wire immediately after it has been hot-rolled.

A further object is to provide such a method and apparatus which cools the wire in such a manner as to impart to it a desired hardness.

SUMMARY OF THE INVENTION

These objects are attained according to the present invention by deflecting the wire as it exits from the coiling machine into the upper end of an upright tube, and then cooling it in this tube as the turns of the coil descend vertically. Such a system ensures almost perfectly uniform treatment of the wire, as the factor of gravity is effective axially of the coil, rather than radially in one direction so that each part of each turn can be treated uniformly. Furthermore, the wire will normally not enter into rubbing contact with the cooling tube, so that the possibility of the wire becoming caught and jamming is greatly reduced.

With the system according to the instant invention it is possible very rapidly and evenly to cool the wire from a temperature above 700° C., normally about 750° C., to a temperature of between 500° C. and 600° C. This rapid cooling is effective to convert at least the surface layer of the wire to martensite, so that the finished product will have excellent strength. Wire thus treated is perfectly suitabe for use as a reinforcement in concrete.

According to another feature of this invention the winding or coiling machine forms a horizontally advancing helix having a succession of vertically oriented turns that are fed into the inlet or upstream end of an elbow whose downstream or outlet end opens vertically downwardly into the funnel-shaped top of the coiling tube. This elbow is provided at its inside edge with an orienting device constituted as a ridged roller that is driven at such a speed that it pivots the turns of the coil or helix about a horizontal axis, accurately and uniformly deflecting the coil from a horizontally advancing coil to a vertically advancing coil without destroying the uniformity of the coil.

The cooling tube is provided in accordance with this invention with a stack of axially spaced manifolds surrounding the tube and each provided with a plurality of inwardly directed nozzles each in turn aligned with a respective throughgoing hole formed in the tube. These nozzles may point directly radially inwardly of the central axis of the tube or tangentially, and can even be tipped to point upwardly or downwardly depending on application. Water is fed to the manifolds under pressure and the spraying effect of the manifolds can be varied relative from one to the other for a perfectly custom-controlled cooling operation.

At the downstream end of the cooling tube according to this invention the coils fall on a horizontally moving foraminous conveyor belt whence they are displaced horizontally away with the turns overlapping each other somewhat. Any water will drip off at this location, although normally most of the water has been converted to steam by the extremely hot wire.

SPECIFIC DESCRIPTION

Figure 1:
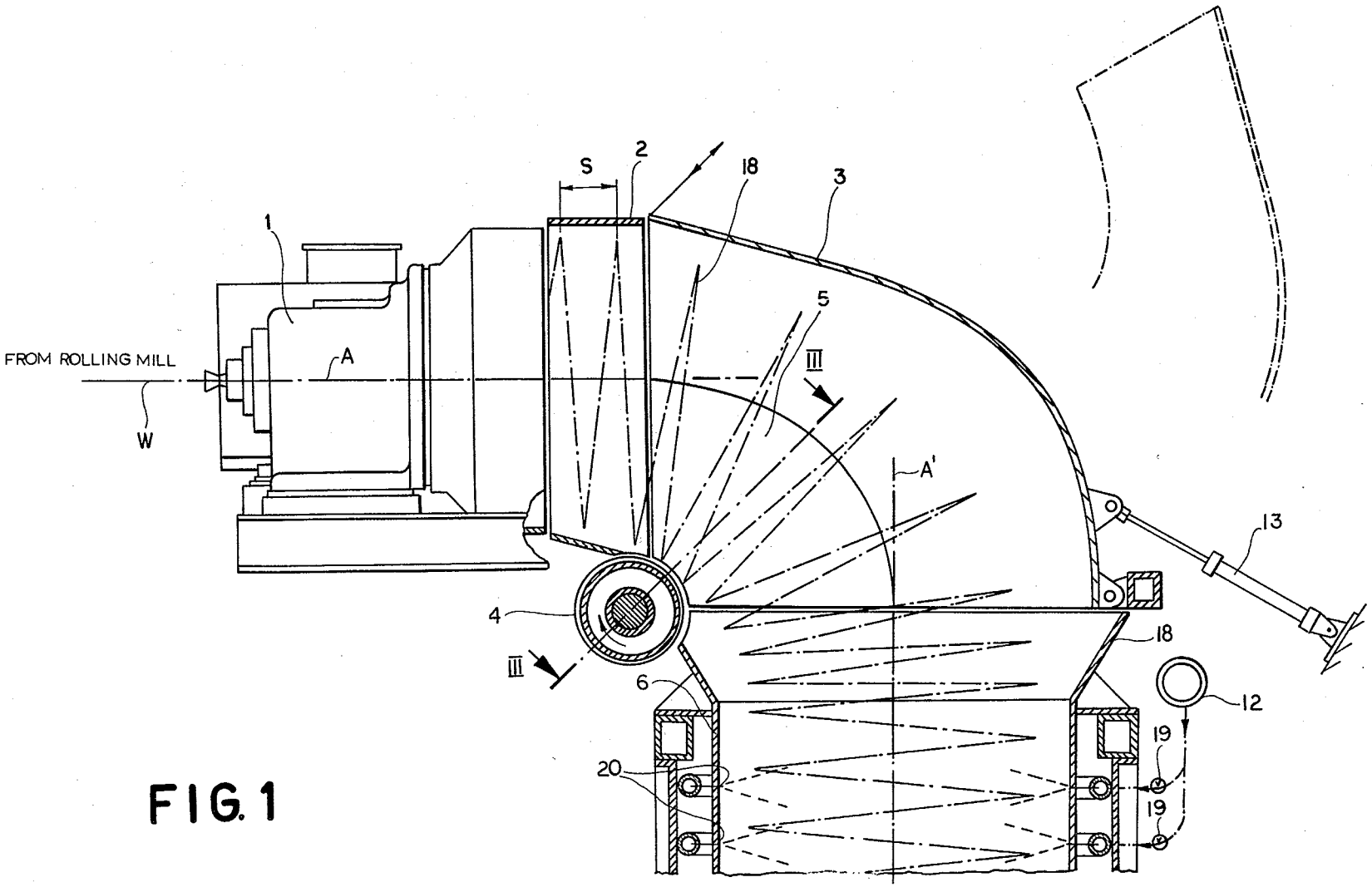
FIGS. 1 and 2 are vertical sections respectively through the upper and lower parts of the apparatus for carrying out the method according to the instant invention.
Figure 2:
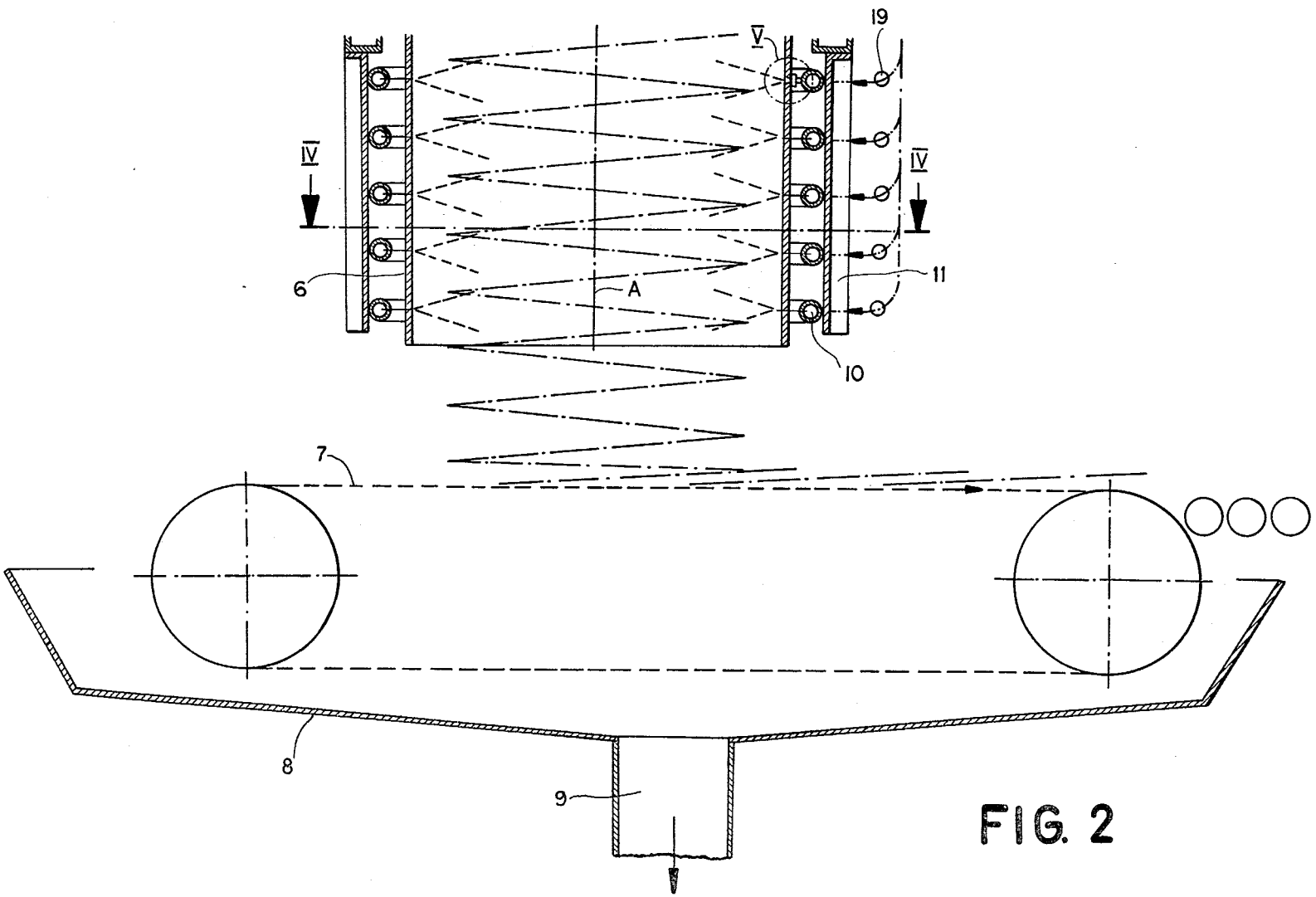
Figure 3:
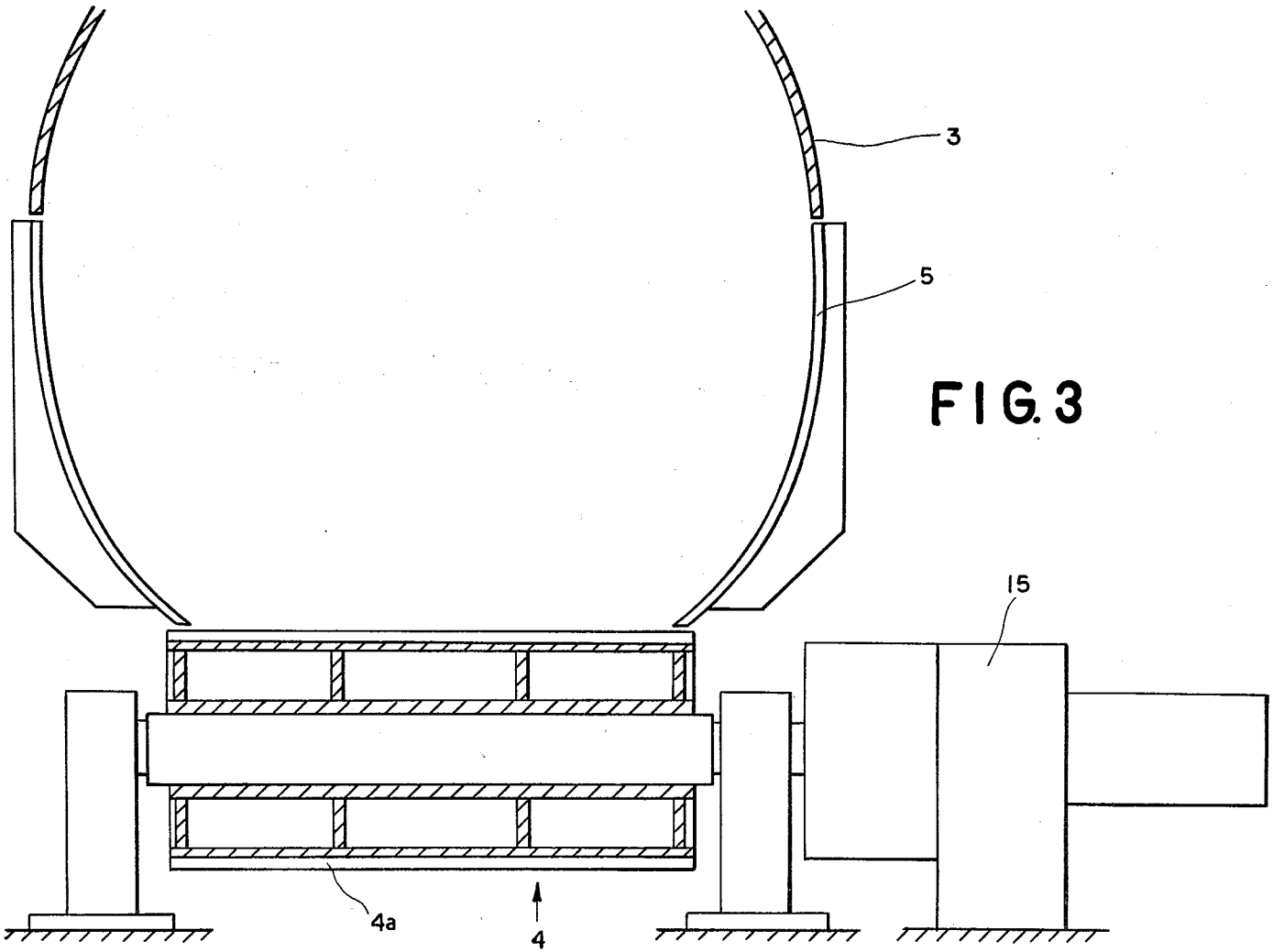
FIGS. 3 and 4 are sections respectively taking along lines III—III and IV—IV of FIGS. 1 and 2.

As shown in FIGS. 1 and 2 the apparatus according to this invention basically comprises a conventional coiling machine 1 which receives a wire W horizontally directly from a rolling mill and forms it into a horizontally extending helix having a succession of turns 16 spaced apart by interturn distance 5 equal to between 100 mm and 200 mm. The temperature of the wire as it exits from the winding machine 1 is approximately 750° C.

Immediately downstream of the coiling machine 1 is an outlet ring 2 which extends horizontally and its horizontal length equals to somewhat more than the interturn spacing 5. Immediately downstream of the guide ring 2 is a guide elbow formed by a pair of side guide plates 5 and a pivotal cover 3 that has an inlet open horizontally toward the coiling machine 1 and an outlet opening vertically downwardly. A hydraulic cylinder 13 can tip the cover part 3 on this elbow back as shown in dot-dash lines in FIG. 1, for clearing of a jam if one occurs. Parts 2, 3, and 5 together, therefore, form a right-angle elbow of substantially circular cross section.

Provided at the inner corner of this elbow 2, 3, 5 is a pivoting or deflecting roller 4 rotating about a horizontal axis and having a multiplicity of axially extending radially projecting vanes 4*a*. This roller 4 has a drive 15 that rotates it synchroneously with the winding machine 1 so that when the turns 16 of the wire W engage it at the inner corner of the elbow these turns 16 will be kept spaced apart and the twins of the wire W will be neatly pivoted through exactly 90° from a position aligned with the axis A of the winding machine 1 to a position aligned with the normal axis A'. This roller is ridged and cylindrical, but may also by hyperboloidal or hourglass-shaped.

A cooling tube 6 having a diameter somewhat greater than the diameters of the turns 16 is aligned with this axis A' and has an upwardly flared frustoconical upper end 18 open directly under the outlet of the elbow 2, 3, 5. Four vertically extending support beams 11 carry a plurality, here five, of vertically spaced and identical pipe rings 10 connected via respective valves 19 to a pump 12 supplying them with high-pressure water at room temperature or colder.

Figure 4:
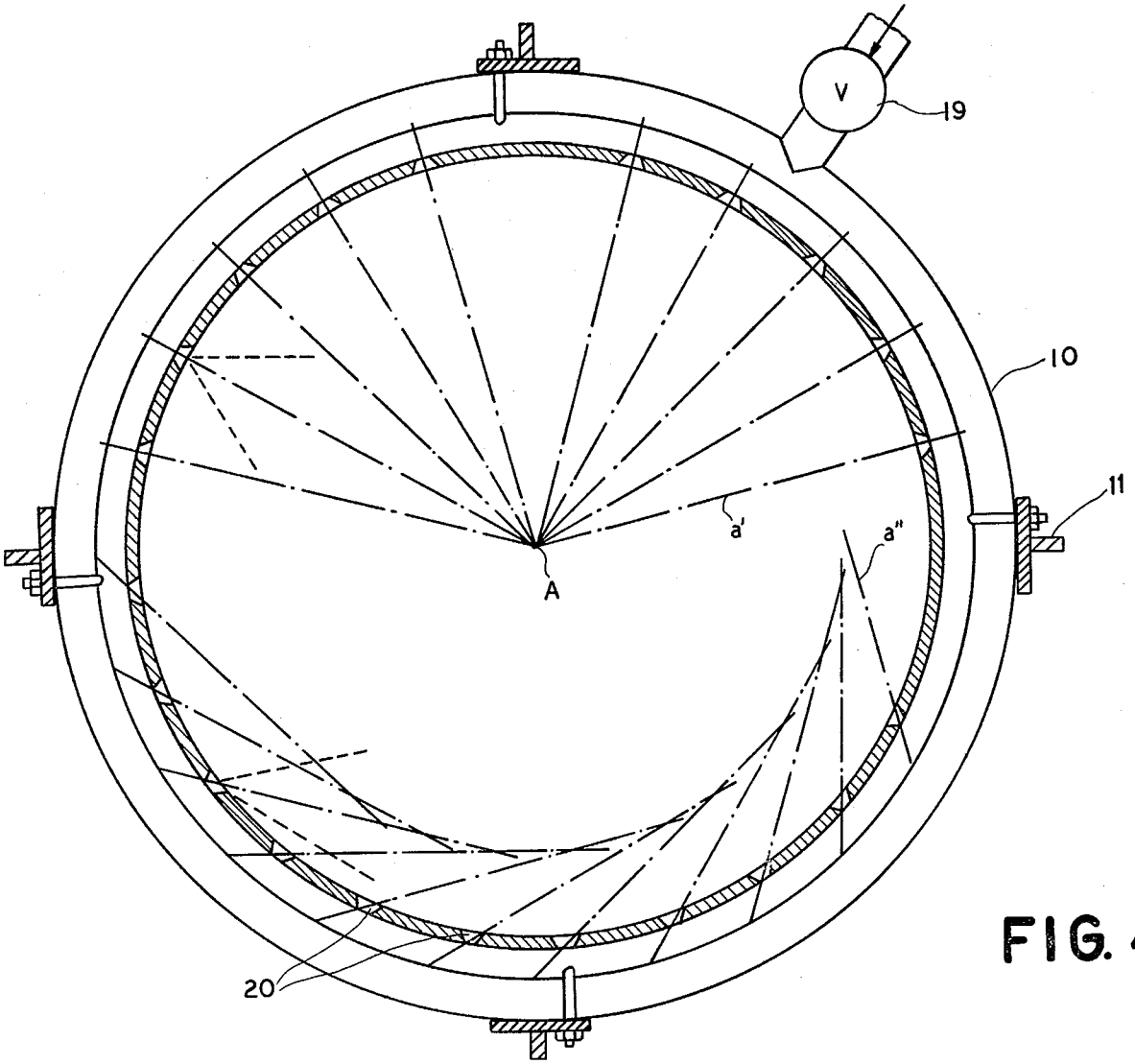
Figure 5:
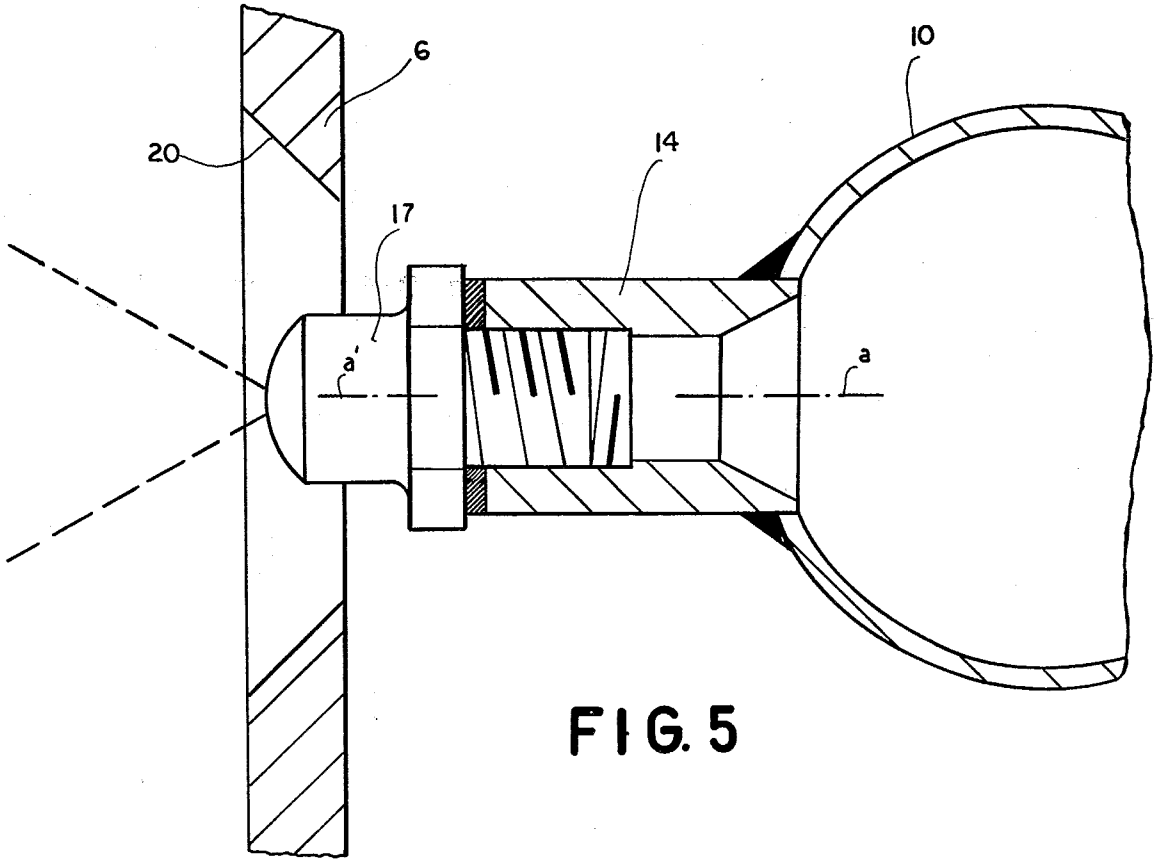
FIG. 5 is a large-scale view of the detail indicated at V in FIG. 2.

The annular tubes or manifolds 10 in turn carry respective mounts 14 centered on axis a which entend perfectly radially of the axis A'. It is possible to screw into these mounts 14 nozzles such as shown in FIG. 5 whose axes a' is parallel to the axis a or as shown in FIG. 4 other nozzles having axes a'that extend tangentially to the axis A'. Of course it is also possible simply to use nozzles having end portions tipped relative to their threaded bases so that the spray can be directed upwardly or downwardly, depending on the type of treatment needed. In any case the tube 6 is formed with a frustoconically inwardly flared hole 20 directly aligned with each nozzle, and sufficiently flared that angled nozzles such as described above can be employed.

On the bottom outward end of the tube 6 there is provided a foraminous conveyor belt 7 that is continuously horizontally displayed to carry the turns 16 away. Below this conveyor 7 is provided a catch through 8 with a drain 9 for any water dripping off the wire W or out of the lower end of the tube 6.

In use the sprays are adjusted so that the wire is rapidly cooled from its starting temperature of approx. 750° C. to a temperature of between 500° C. and 600° C. This transforms the surface at least of the wire into martensite so that it is possible to impart to a standard steel wire the strength of an alloy steel wire of considerably higher cost, producing a product ideally suitable for use as concrete reinforcement. This thermal hardening can be controlled very easily by the water pressure, which valves 19 are open, and various other means apparent from this structure so that the exact cooling effect desired is achieved.

At the same time this system operates in such a simple manner that it is very unlikely that it would jam. The roller 4 carefully aligns the turns 16 of the wire W while keeping them out of contact with each other so that perfectly uniform treatment of each turn 16 is ensured. Under normal operating circumstances the wire will hardly touch the walls of the tube 6 so that abrasion and wear are almost completely eliminated and the apparatus can be expected to have a very long service life.

I claim:

1. An apparatus for treating a wire immediately after hot-formation thereof, said apparatus comprising:

an upright cooling tube having an upper end and a lower end;

coiling means for forming said wire into a continuously advancing helix having a succession of turns;

guide means between said coiling means and said upper end for feeding said continuously advancing helix into said upper end and thereby causing said helix to drop vertically in said tube;

cooling means in said tube for spraying said helix therein with a fluid cooling medium and thereby cooling said helix; and conveyor means at said lower end for receiving the cooled helix and conducting same away from said lower end.

2. The apparatus defined in claim 1 wherein said coiling means is horizontally oriented and delivers said helix centered on a horizontal axis.

3. The apparatus defined in claim 2 wherein said guide means includes a guide elbow having a horizontally opening inlet at said coiling means and a vertically downwardly opening outlet at said upper end.

4. The apparatus defined in claim 3 wherein said guide means includes means engageable with said turns for pivoting same between a vertical and a horizontal orientation.

5. The apparatus defined in claim 4 wherein said means for pivoting includes a ridged roller engageable in said elbow with said turns and means for rotating said roller at a speed different from the speed of advance of said helix.

6. The apparatus defined in claim 3 wherein said tube has an upwardly flared portion at its upper end opening below said outlet of said elbow.

7. The apparatus defined in claim 1 wherein said cooling means includes a plurality of manifolds outside said tube and a plurality of inwardly directed nozzles mounted on each of said manifolds, said tube being formed with a multiplicity of through-going holes each alinged with a respective nozzle.

8. The apparatus defined in claim 7 wherein each of said holes is outwardly tapered and centered on the respective nozzle.

9. The apparatus defined in claim 7 wherein said manifolds are vertically spaced and each formed as a horizontally oriented ring surrounding said tube.

10. The apparatus defined in claim 7 wherein said nozzles are directed radially inwardly relative to a vertical central axis of said tube.

11. The apparatus defined in claim 7 wherein said nozzles are directed tangentially inwardly.

* * * * *